US008514667B2

(12) United States Patent
Akiyama et al.

(10) Patent No.: US 8,514,667 B2
(45) Date of Patent: Aug. 20, 2013

(54) ELECTRONIC TIMEPIECE AND RECEPTION CONTROL METHOD FOR AN ELECTRONIC TIMEPIECE

(75) Inventors: Toshikazu Akiyama, Nagano-ken (JP); Oh Jaekwan, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 29 days.

(21) Appl. No.: 13/367,066

(22) Filed: Feb. 6, 2012

(65) Prior Publication Data

US 2012/0201101 A1 Aug. 9, 2012

(30) Foreign Application Priority Data

Feb. 9, 2011 (JP) ..... 2011-026510

(51) Int. Cl.
*G04C 11/02* (2006.01)

(52) U.S. Cl.
USPC ..... 368/47

(58) Field of Classification Search
USPC ..... 368/10, 46, 47
See application file for complete search history.

(56) References Cited

U.S. PATENT DOCUMENTS

| | | | | |
|---|---|---|---|---|
| 5,923,618 | A * | 7/1999 | Nelson et al. | 368/28 |
| 7,447,931 | B1 * | 11/2008 | Rischar et al. | 713/400 |
| 7,948,833 | B2 * | 5/2011 | Ha et al. | 368/47 |
| 8,233,354 | B2 * | 7/2012 | Fujisawa | 368/47 |
| 2002/0186619 | A1 * | 12/2002 | Reeves et al. | 368/47 |
| 2008/0165628 | A1 * | 7/2008 | Urano | 368/47 |

FOREIGN PATENT DOCUMENTS

| | | | |
|---|---|---|---|
| JP | 2008-145287 | A | 6/2008 |
| JP | 2009-250801 | A | 10/2009 |
| JP | 2011-033381 | A | 2/2011 |

* cited by examiner

*Primary Examiner* — Vit W Miska

(57) ABSTRACT

An electronic timepiece can easily acquire a leap second information reception time with minimal processor load. A first table groups leap second information reception times expressed by hour, minute, second, and day values into plural minute-second patterns of minute-second combinations that are common to plural hours, and relates numbers identifying these minute-second patterns to the day and hour values. The minute-second combinations are grouped by number in a second table. The number corresponding to the day and hour of the internal time is found from the first table (S1). A minute-second combination that is later than the internal time is found from the minute-second combinations corresponding to the acquired number (S2). And leap second reception time is calculated. If the resulting leap second reception time matches the internal time is determined (S9). If the times match, the leap second information is received (S10, S11).

8 Claims, 10 Drawing Sheets

| HOUR / DAY | 0,5,10,15,20 | 1,6,11,16,21 | 2,7,12,17,22 | 3,8,13,18,23 | 4,9,14,19 |
|---|---|---|---|---|---|
| SUN, FRI | 0 | 1 | 2 | 3 | 4 |
| MON, SAT | 4 | 0 | 1 | 2 | 3 |
| TUE | 3 | 4 | 0 | 1 | 2 |
| WED | 2 | 3 | 4 | 0 | 1 |
| THURS | 1 | 2 | 3 | 4 | 0 |

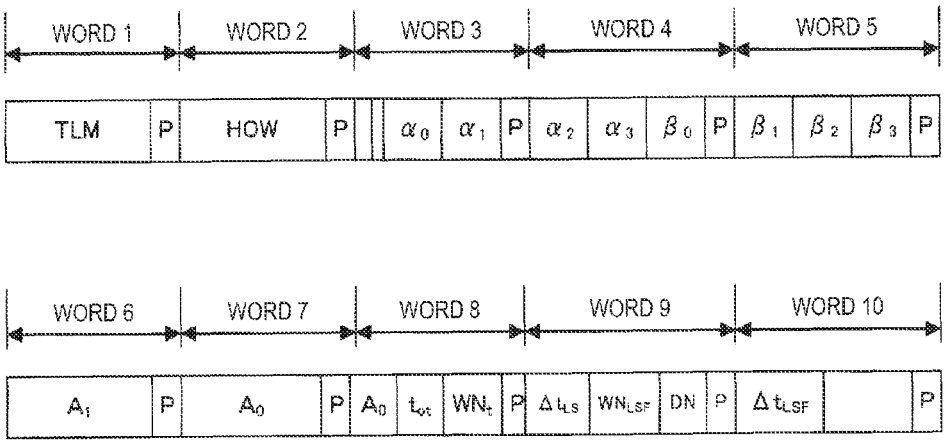

| WORD | BIT POSITION | BITS | CONTENT | | SCALE | UNIT |
|---|---|---|---|---|---|---|
| 1 | 1 | 22 | TLM | TELEMETRY WORD | | |
| 2 | 31 | 22 | HOW | HANDOVER WORD | | |
| 3 | 63 | 6 | SV ID | PAGE ID = 56 | | |
| | 69 | 8 | $\alpha_0$ | IONOSPHERIC CORRECTION FACTOR | −30 | s |
| | 77 | 8 | $\alpha_1$ | IONOSPHERIC CORRECTION FACTOR | −27 | s/sc |
| 4 | 91 | 8 | $\alpha_2$ | IONOSPHERIC CORRECTION FACTOR | −24 | $s/sc^2$ |
| | 99 | 8 | $\alpha_3$ | IONOSPHERIC CORRECTION FACTOR | −24 | $s/sc^3$ |
| | 107 | 8 | $\beta_0$ | IONOSPHERIC CORRECTION FACTOR | 11 | s |
| 5 | 121 | 8 | $\beta_1$ | IONOSPHERIC CORRECTION FACTOR | 14 | s/sc |
| | 129 | 8 | $\beta_2$ | IONOSPHERIC CORRECTION FACTOR | 16 | $s/sc^2$ |
| | 137 | 8 | $\beta_3$ | IONOSPHERIC CORRECTION FACTOR | 16 | $s/sc^3$ |
| 6 | 151 | 24 | $A_1$ | UTC PARAMETER | −50 | s/s |
| 7 | 181 | 24MSB | $A_0$ | UTC PARAMETER | −30 | s |
| 8 | 211 | 8LSB | | | | |
| | 219 | 8 | $t_{ot}$ | EPOCH TIME (UTC) | 12 | weeks |
| | 227 | 8 | $WN_t$ | | | |
| 9 | 241 | 8 | $\Delta t_{LS}$ | CURRENT LEAP SECOND | 0 | s |
| | 249 | 8 | $WN_{LSF}$ | WEEK LEAP SECOND UPDATES | 0 | weeks |
| | 257 | 8 | DN | DAY LEAP SECOND UPDATES | 0 | days |
| 10 | 271 | 8 | $\Delta t_{LSF}$ | LEAP SECOND AFTER CORRECTION | 0 | s |

FIG. 6

| No | CUMULATIVE SUBFRAME NUMBER | GPS TIME | HOUR | MINUTE | SECOND | DAY |
|---|---|---|---|---|---|---|
| 1 | 89 | 528 | 0 | 8 | 48 | SUN |
| 2 | 214 | 1278 | 0 | 21 | 18 | SUN |
| 3 | 339 | 2028 | 0 | 33 | 48 | SUN |
| 4 | 464 | 2778 | 0 | 46 | 18 | SUN |
| 5 | 589 | 3528 | 0 | 58 | 48 | SUN |
| : | : | : | : | : | : | : |
| 802 | 100214 | 601278 | 23 | 1 | 18 | SAT |
| 803 | 100339 | 602028 | 23 | 13 | 48 | SAT |
| 804 | 100464 | 602778 | 23 | 26 | 18 | SAT |
| 805 | 100589 | 603528 | 23 | 38 | 48 | SAT |
| 806 | 100714 | 604278 | 23 | 51 | 18 | SAT |

FIG. 7

| DAY \ HOUR | 0,5,10,15,20 | 1,6,11,16,21 | 2,7,12,17,22 | 3,8,13,18,23 | 4,9,14,19 |
|---|---|---|---|---|---|
| SUN, FRI | 0 | 1 | 2 | 3 | 4 |
| MON, SAT | 4 | 0 | 1 | 2 | 3 |
| TUE | 3 | 4 | 0 | 1 | 2 |
| WED | 2 | 3 | 4 | 0 | 1 |
| THURS | 1 | 2 | 3 | 4 | 0 |

FIG. 8A

| TABLE NUMBER | MINUTE | SECOND |
|---|---|---|
| 0 | 08 | 48 |
| | 21 | 18 |
| | 33 | 48 |
| | 46 | 18 |
| | 58 | 48 |
| 1 | 11 | 18 |
| | 23 | 48 |
| | 36 | 18 |
| | 48 | 48 |
| 2 | 01 | 18 |
| | 13 | 48 |
| | 26 | 18 |
| | 38 | 48 |
| | 51 | 18 |
| 3 | 03 | 48 |
| | 16 | 18 |
| | 28 | 48 |
| | 41 | 18 |
| | 53 | 48 |
| 4 | 06 | 18 |
| | 18 | 48 |
| | 31 | 18 |
| | 43 | 48 |
| | 56 | 18 |

FIG. 8B

ELECTRONIC TIMEPIECE AND RECEPTION CONTROL METHOD FOR AN ELECTRONIC TIMEPIECE

CROSS-REFERENCE TO RELATED APPLICATION

The entire disclosure of Japanese Patent Application No. 2011-026510, filed Feb. 9, 2011 is expressly incorporated by reference herein.

BACKGROUND

1. Technical Field

The present invention relates to an electronic timepiece that receives satellite signals transmitted from positioning information satellites such as GPS satellites to obtain current date and time information, and to a reception control method for an electronic timepiece.

2. Related Art

Japanese Unexamined Patent Appl. Pub. JP-A-2008-145287 teaches a leap second correction method for acquiring subframe and page identification information from navigation data, and calculating the time when leap second correction data will be received from the subframe and page identification information. This leap second correction method stores the calculated leap second reception time in a storage unit.

The method taught in JP-A-2008-145287 digitizes the page number and subframe where the leap second information is stored, as well as the page number and subframe obtained from GPS measurements, and calculates the reception time of the leap second correction data from a specific equation using these values. This applies a burdensome load on the processor if a low power processor is used. A common GPS receiver module also outputs data in NMEA format, but the subframe and page identification information are not included in this output.

JP-A-2008-145287 also describes storing calculated leap second reception times in memory, but searching for the reception time takes too long if all reception times are stored because of the large amount of data. To reduce the amount of stored data, JP-A-2008-145287 therefore only stores data around 23:00 at the month end, and determines the reception time from a specific operation if the time does not match. This results in a heavy load on the processor if a low power processor is used.

SUMMARY

An electronic timepiece and reception control method for an electronic timepiece according to the invention can easily acquire leap second reception time information with a low processor load.

A first aspect of the invention is an electronic timepiece including: a reception unit that can receive satellite signals from satellites that transmit satellite signals containing time information and leap second information; a control unit that controls the reception unit to receive the time information and the leap second information from the satellite signal, and adjusts an internal time based on the time information and leap second information; a first table that groups combinations of reception-minute and reception-second values common to plural reception-hours into a plurality of minute-second combinations based on leap second reception time data expressing leap second information reception times by means of reception-hour, reception-minute, reception-second, and reception-day values, and relates an identification value for the plural minute-second combinations to the reception-day and reception-hour values; and a second table that stores reception-minute and reception-second combinations for each identification value; wherein the control unit acquires a leap second reception time that is later than the internal time from the first table and the second table, and controls the reception unit to receive the leap second information based on the acquired leap second reception time.

The electronic timepiece according to this aspect of the invention groups combinations of reception-minute and reception-second values common to plural reception-hours into a plurality of minute-second combinations, and relates an identification value for the plural minute-second combinations to the reception-day and reception-hour values in a first table, and stores reception-minute and reception-second combinations for each identification value in a second table, and can thereby significantly reduce the table size. In addition, because small data tables can be searched, the leap second information reception time can be found quickly, the satellite signal reception time can be shortened, and power consumption by the electronic timepiece can be reduced.

The invention can therefore provide an electronic timepiece that can easily acquire the timing for receiving leap second information with minimal processor load.

In an electronic timepiece according to another aspect of the invention, the leap second reception time preferably denotes a start-reception time for leap second information as the difference of the time leap second information transmission starts minus the difference between the time information and Universal Coordinated Time (UTC). The control unit determines if the difference between the time information and UTC changed from when the first table and the second table were compiled. If the difference changed, the control unit controls the reception unit to receive the leap second information when the internal time matches the time difference of the minute-second combination corresponding to the acquired identification value minus the change.

As a result, the leap second information reception time can be found easily and accurately with little processor load even if the difference between the time information and UTC has changed since the table was compiled.

In an electronic timepiece according to another aspect of the invention, the leap second reception time expresses the time to start receiving leap second information in terms of UTC.

As a result, deviation between the time carried by the satellite signal and the time where the electronic timepiece is actually used can be eliminated, and the timing for receiving leap second information can be accurately acquired easily with little processor load where the electronic timepiece is actually located.

In an electronic timepiece according to another aspect of the invention, the leap second reception time is preferably the time leap second information transmission starts; and the control unit subtracts the time required for reception from the leap second reception time, and when this difference minus the difference between the time information and UTC matches the internal time, controls the reception unit to receive the leap second information.

This aspect of the invention enables acquiring leap second information accurately and easily with little processor load without changing the leap second reception time data once it is compiled.

In an electronic timepiece according to another aspect of the invention, the leap second reception time is the time leap second information transmission starts as expressed by the time information in the satellite signal.

By using the time information from the satellite signal, this aspect of the invention enables acquiring leap second information accurately and easily with little processor load without changing the leap second reception time data once it is compiled by accounting for the time required for reception and the difference between the time information and UTC at the time the leap second information is received.

Another aspect of the invention is a reception control method for an electronic timepiece that has a reception unit that can receive satellite signals from satellites that transmit satellite signals containing time information and leap second information, a control unit that controls the reception unit to receive the time information and the leap second information from the satellite signal, and adjusts an internal time based on the time information and leap second information, a first table that groups combinations of reception-minute and reception-second values common to plural reception-hours into a plurality of minute-second combinations based on leap second reception time data expressing leap second information reception times by means of reception-hour, reception-minute, reception-second, and reception-day values, and relates an identification value for the plural minute-second combinations to the reception-day and reception-hour values, and a second table that stores reception-minute and reception-second combinations for each identification value. The reception control method includes steps of: acquiring the minute-second combination identification value from the first table based on the day and hour of the internal time; acquiring a reception-minute and reception-second combination that is later than the internal time from the minute-second combinations corresponding to the acquired identification value; determining if the internal time matches the reception-day and reception-hour corresponding to the acquired identification value and the acquired reception-minute and reception-second combination; and starting receiving the leap second information if the internal time matches.

The reception control method for an electronic timepiece according to this aspect of the invention groups combinations of reception-minute and reception-second values common to plural reception-hours into a plurality of minute-second combinations, and relates an identification value for the plural minute-second combinations to the reception-day and reception-hour values in a first table, and stores reception-minute and reception-second combinations for each identification value in a second table, and can thereby significantly reduce the table size. In addition, because small data tables can be searched, the leap second information reception time can be found quickly, the satellite signal reception time can be shortened, and power consumption by the electronic timepiece can be reduced.

The invention can therefore provide a reception control method for an electronic timepiece that can easily acquire the timing for receiving leap second information with minimal processor load.

In a reception control method for an electronic timepiece according to another aspect of the invention, the leap second reception time preferably denotes a start-reception time for leap second information as the difference of the time leap second information transmission starts minus the difference between the time information and Universal Coordinated Time (UTC), and the control method also includes steps of determining if the difference between the time information and UTC changed from when the first table and the second table were compiled; and if the difference changed, subtracting the change from the minute-second combination corresponding to the acquired identification value.

As a result, the leap second information reception time can be found easily and accurately with little processor load even if the difference between the time information and UTC has changed since the table was compiled.

In a reception control method for an electronic timepiece according to another aspect of the invention, the leap second reception time data denotes the time transmitting the leap second information starts. In this case, the reception control method also includes steps of: subtracting time required for reception from the acquired reception-day and reception-hour corresponding to the acquired identification value and the acquired reception-minute and reception-second combination; and subtracting from this difference the difference between the time information and UTC.

This aspect of the invention enables acquiring leap second information accurately and easily with little processor load without changing the leap second reception time data once it is compiled by accounting for the time required for reception and the difference between the time information and UTC at the time the leap second information is received.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 6 shows the content of subframe 4 of page 18 in a navigation message received by the electronic timepiece 100.

FIG. 7 is a table showing the hour, minute, second, and weekday values of the times when subframe 4 of page 18 can be received.

FIG. 8 is a leap second reception time table according to a first embodiment of the invention, (A) being a table of five patterns of minute and second values of the leap second reception times correlated to the hour from 0 to 23 and the weekday from Sunday to Saturday, and (B) being a table of the minute and second values of the leap second reception times for each table number where the table number is the number of a particular pattern in table (A).

DESCRIPTION OF EMBODIMENTS

Preferred embodiments of the present invention are described below with reference to the accompanying figures.

Note that the size and scale of parts shown in the figures differ from the actual for convenience. Furthermore, because the following examples are specific preferred embodiments of the invention and describe technically desirable limitations, the scope of the invention is not limited thereby unless such limitation is specifically stated below.

Figure 1:
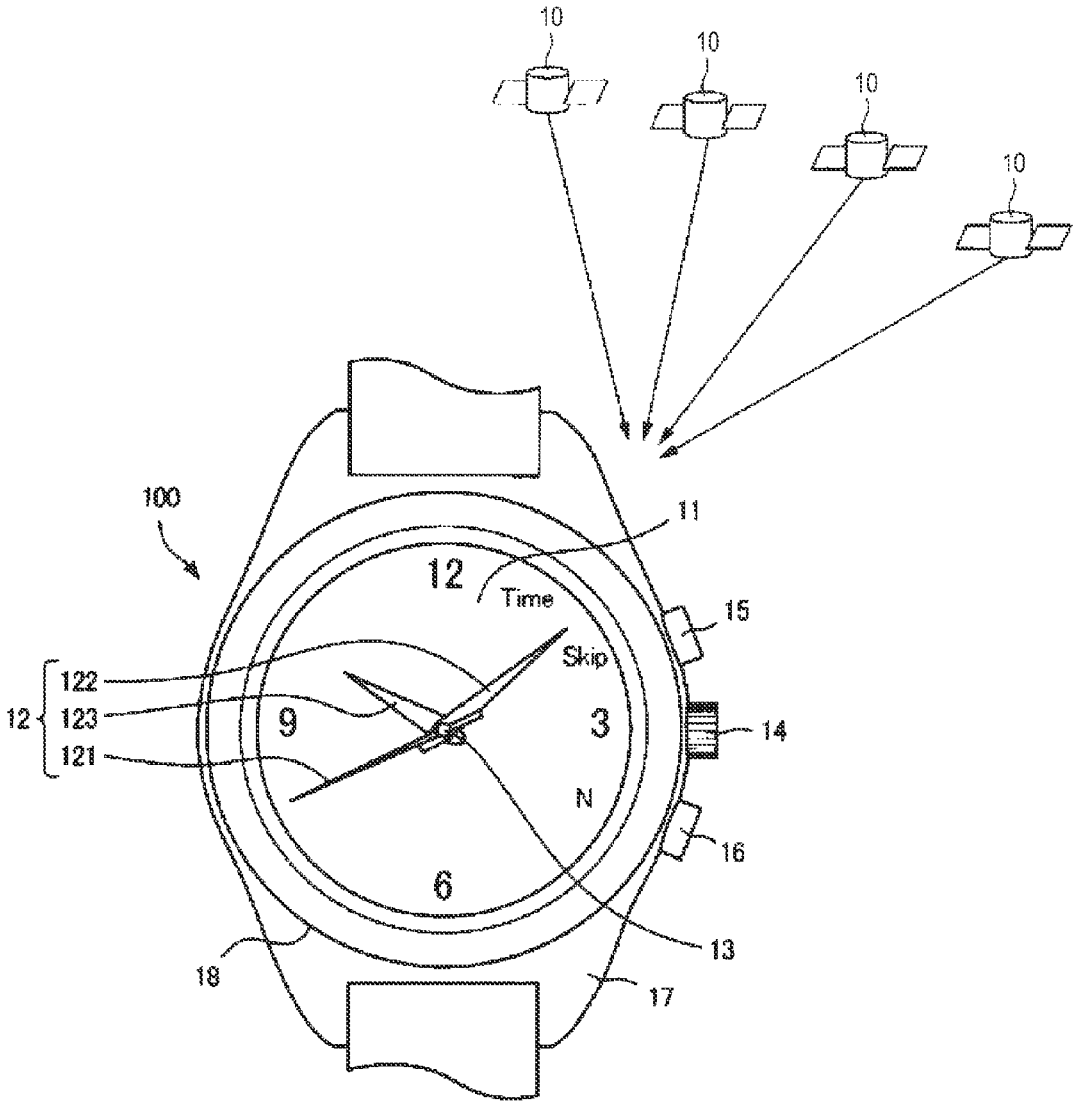
FIG. 1 shows the general configuration of a GPS system including, an electronic timepiece with internal antenna 100 (electronic timepiece 100) according to a first embodiment of the invention.
Figure 2:
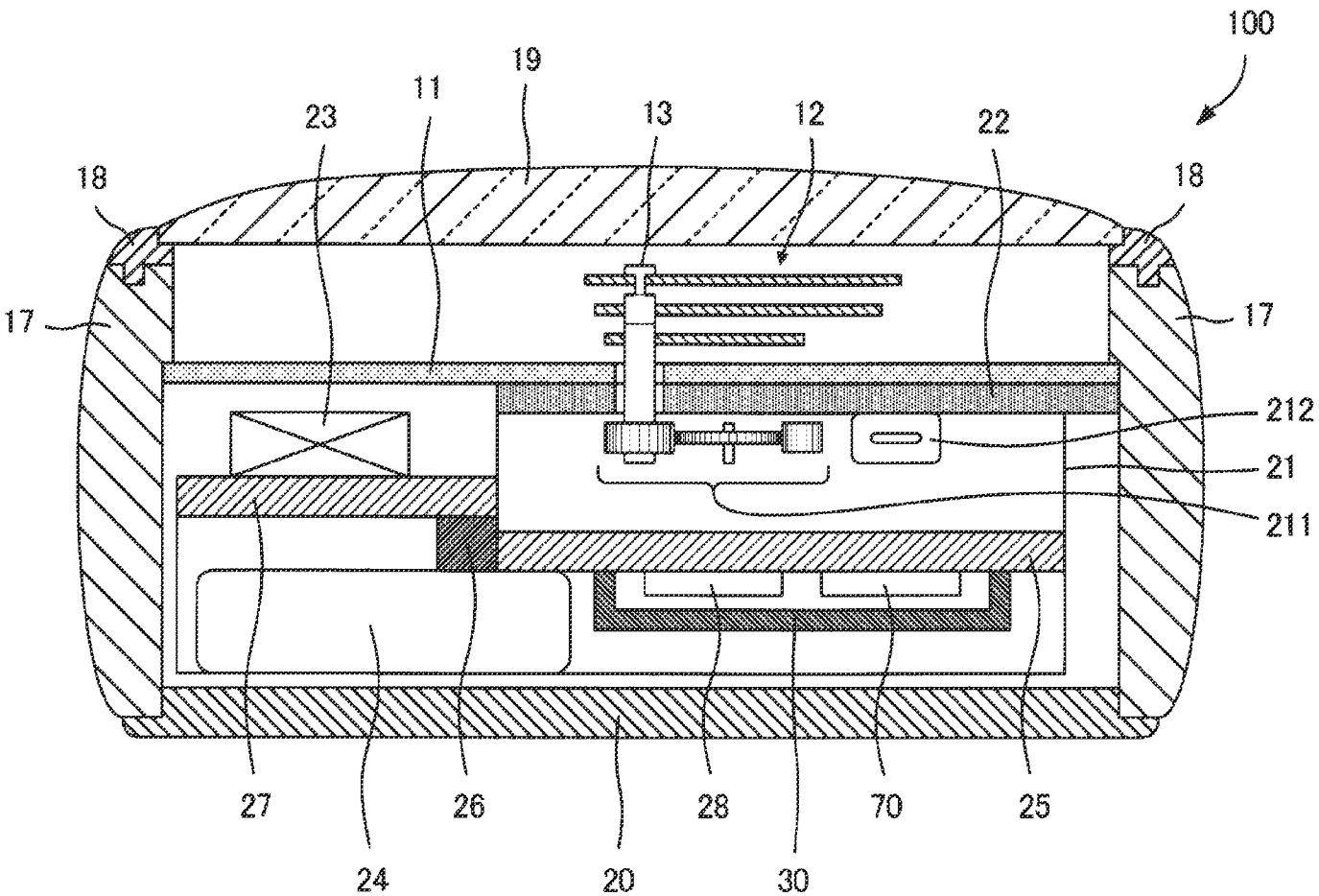
FIG. 2 is a partial section view of the electronic timepiece 100.

FIG. 1 is a plan view of an electronic timepiece 100 according to a first embodiment of the invention, and FIG. 2 is a section view of part of the electronic timepiece 100. As will be understood from FIG. 1, the electronic timepiece 100 is a wristwatch that is worn on the user's wrist, has a dial 11 and hands 12, and keeps and displays time on the face. Most of the dial 11 is made from a non-metallic material (such as plastic or glass) through which light and microwaves in the 1.5 GHz band can pass easily. The hands 12 are disposed on the face side of the dial 11, include a second hand 121, minute hand 122, and hour hand 123 that rotate on a center shaft 13, and are driven by a stepper motor through an intervening wheel train.

The electronic timepiece 100 executes processes called by manually operating the crown 14, button 15, and button 16. More specifically, when the crown 14 is operated, a time adjustment process that corrects the displayed time according to how the crown 14 is operated is performed. When the button 15 is depressed for an extended time (such as 3 or more seconds), a reception process for receiving satellite signals is performed. When button 16 is pressed, a switching process for turning automatic reception on and off is performed. When automatic reception is enabled (on), the reception process is executed at a fixed interval (such as once a day).

If the button 15 is pressed for a short time, a display result process that displays the result of the previous reception process is performed. For example, the second hand 121 jumps to the position marked Time (the 5-second position) if reception was successful during the last reception process, the second hand 121 jumps to the N position (20-second position) if reception failed, and the second hand 121 jumps to the Skip position (10-second position) if reception was not attempted.

As shown in FIG. 2, the electronic timepiece 100 has an outside case 17 that is made of stainless steel, titanium, or other metal. The outside case 17 is basically cylindrically shaped, and a crystal 19 is attached to the opening on the face side of the outside case 17 by an intervening bezel 18. The bezel 18 is made from a non-metallic material such as ceramic in order to improve satellite signal reception performance. A back cover 20 is attached to the opening on the back side of the outside case 17. Inside the outside case 17 are disposed a movement 21, a solar cell 22, a GPS antenna 23, and a storage battery 24.

The movement 21 includes a stepper motor and wheel train 211. The stepper motor has a motor coil 212, a stator and a rotor, and drives the hands 12 through the wheel train 211 and rotating center shaft 13.

A circuit board 25 is disposed on the back cover 20 side of the movement 21, and the circuit board 25 is connected through a connector to an antenna circuit board 27 and the storage battery 24.

A GPS reception circuit 28 including a reception circuit for processing satellite signals received through the GPS antenna 23, and the control circuit 70 that controls driving the stepper motor, for example, are mounted on the circuit board 25. The GPS reception circuit 28 and control circuit 70 are covered by a shield plate 30, and are driven by power supplied from the storage battery 24.

The solar cell 22 is a photovoltaic device that converts light energy to electrical energy and outputs power, has an electrode for outputting the produced power, and is disposed on the back cover side of the dial 11. Most of the dial 11 is made from a material that easily passes light, and the solar cell 22 receives and converts light passing through the crystal 19 and dial 11 to electrical power.

The storage battery 24 is the power supply for the electronic timepiece 100, and stores power produced by the solar cell 22. The two electrodes of the solar cell 22 and the two electrodes of the storage battery 24 can be electrically connected in the electronic timepiece 100, and the storage battery 24 is charged by the photovoltaic power generation of the solar cell 22 when thus electrically connected. Note that this embodiment of the invention uses a lithium ion battery, which is well suited to mobile devices, as the storage battery 24, but the invention is not so limited and lithium polymer batteries or other types of storage batteries, or a storage device other than a storage battery (such as a capacitive device), may be used instead.

The GPS antenna 23 is an antenna that can receive microwaves in the 1.5 GHz band, and is mounted on the antenna circuit board 27 located on the back cover 20 side behind the dial 11. The part of the dial 11 overlapping the GPS antenna 23 in the direction perpendicular to the dial 11 is made from a material through which 1.5-GHz microwave signals pass easily (such as a non-metallic material with low conductivity and low magnetic permeability). The solar cell 22 with electrodes does not intervene between the GPS antenna 23 and the dial 11. The GPS antenna 23 can therefore receive satellite signals passing through the crystal 19 and the dial 11.

As the distance between the GPS antenna 23 and the solar cell 22 decreases, loss can result due to electrical connection between metal components of the GPS antenna 23 and the solar cell 22, resulting in the solar cell 22 blocking and reducing the radiation pattern of the GPS antenna 23. Therefore, to prevent a drop in reception performance, the GPS antenna 23 and solar cell 22 are disposed with at least a specific distance therebetween.

The GPS antenna 23 is also disposed with at least a specific distance to metal parts other than the solar cell 22. For example, if the outside case 17 and movement 21 contain metal parts, the GPS antenna 23 is disposed so that the distance to the outside case 17 and the distance to the movement 21 is at least this specific distance. Note that a patch antenna (microstrip antenna), helical antenna, chip antenna, or inverted F-type antenna, for example, could be used as the GPS antenna 23.

The GPS reception circuit 28 is a load that is driven by power stored in the storage battery 24, attempts to receive satellite signals from the GPS satellites 10 through the GPS antenna 23 each time the GPS reception circuit 28 is driven, supplies the acquired orbit information, GPS time information, and other information to the control circuit 70 when reception succeeds, and sends a failure report to the control circuit 70 when reception fails.

In this embodiment of the invention the GPS reception circuit 28 uses a 20-mA drive current, and requires 30 seconds to receive a satellite signal. The single-reception power consumption, which is the amount of power consumed to drive the GPS reception circuit 28 once, is therefore 20 mA×30 sec=0.17 mAH. This single-reception power consumption is used as a decision threshold in the reception process, and is predefined. This evaluation is further described below. Note that the configuration of the GPS reception circuit 28 is the same as the configuration of a common GPS reception circuit, and further description thereof is thus omitted.

Figure 3:
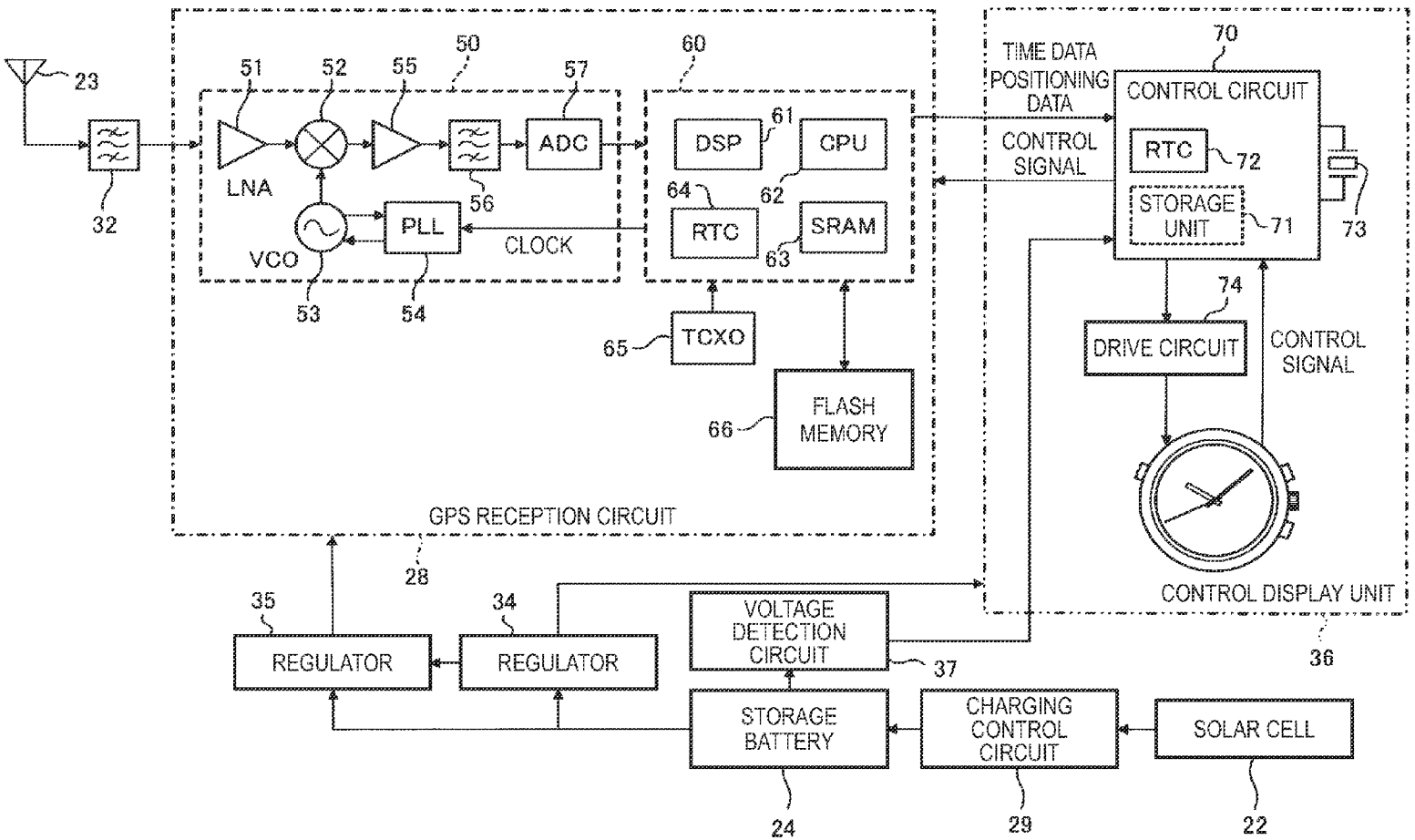
FIG. 3 is a block diagram showing the circuit configuration of the electronic timepiece 100.

FIG. 3 is a block diagram showing the circuit configuration of the electronic timepiece 100.

The electronic timepiece 100 is configured with a GPS reception circuit 28 and a control display unit 36. The GPS reception circuit 28 executes processes including receiving satellite signals, capturing GPS satellites 10, generating positioning information, and generating time adjustment information. The control display unit 36 executes processes including keeping internal time information, and correcting the internal time information.

The solar cell 22 charges the storage battery 24 with power through the charging control circuit 29. The electronic timepiece 100 also includes regulators 34 and 35, and the storage battery 24 supplies drive power through regulator 34 to the control display unit 36, and through regulator 35 to the GPS reception circuit 28. The electronic timepiece 100 also has a voltage detection circuit 37 that detects the storage battery 24 voltage.

Alternatively, the regulator 35 could be split into a regulator 35-1 (not shown in the figure) that supplies drive power to the RF unit 50 (described below), and a regulator 35-2 (not shown in the figure) that supplies drive power to the baseband unit 60 (described below). In this case, regulator 35-1 could be disposed in the RF unit 50.

The electronic timepiece 100 also has the GPS antenna 23 and a SAW (surface acoustic wave) filter 32. As described in FIG. 2, the GPS antenna 23 is a slot antenna that receives satellite signals from a plurality of GPS satellites 10. However, because the GPS antenna 23 also receives some extraneous signals other than satellite signals, the SAW filter 32 executes a process that extracts the satellite signals from the signals received by the GPS antenna 23. More specifically, the SAW filter 32 is configured as a bandpass filter that passes signals in the 1.5 GHz waveband.

The GPS reception circuit 28 includes the RF (radio frequency) unit 50 and baseband unit 60. As described below, the GPS reception circuit 28 executes a process that acquires satellite information including orbit information and GPS time information contained in the navigation messages from the satellite signals in the 1.5 GHz band extracted by the SAW filter 32.

The RF unit 50 is composed of a LNA (low noise amplifier) 51, mixer 52, VCO (voltage controlled oscillator) 53, PLL (phase-locked loop) circuit 54, IF (intermediate frequency) amplifier 55, IF filter 56, and A/D converter 57.

Satellite signals extracted by the SAW filter 32 are amplified by the LNA 51. The satellite signals amplified by the LNA 51 are mixed by the mixer 52 with the clock signal output by the VCO 53, and down-converted to a signal in the intermediate frequency band. The PLL circuit 54 phase compares a clock signal obtained by frequency dividing the output clock signal of the VCO 53 with a reference clock signal, and synchronizes the clock signal output from the VCO 53 to the reference clock signal. As a result, the VCO 53 can output a stable clock signal with the frequency precision of the reference clock signal. Note that several megahertz, for example, can be selected as the intermediate frequency.

The mixed signal output from the mixer 52 is amplified by the IF amplifier 55. This mixing by the mixer 52 results in both an IF signal and a high frequency signal of several GHz. As a result, the IF amplifier 55 amplifies both the IF signal and the high frequency signal of several gigahertz. The IF filter 56 passes the IF signal and removes the high frequency signal of several gigahertz (more accurately, attenuates the signal to a specific level or less). The IF signal passed by the IF filter 56 is converted to a digital signal by the A/D converter 57.

The baseband unit 60 includes a DSP (digital signal processor) 61, CPU (central processing unit) 62, SRAM (static random access memory) 63, RTC (real-time clock) 64. A TCXO (temperature compensated crystal oscillator) 65 and flash memory 66 are also connected to the baseband unit 60.

The TCXO 65 generates a reference clock signal of a substantially constant frequency regardless of temperature. Time difference information, for example, is stored in flash memory 66. The time difference information is information with a defined time difference (such as correction to UTC related to coordinates (such as latitude and longitude)).

The baseband unit 60 executes a process that demodulates the baseband signal from the digital signal (IF signal) converted by the A/D converter 57 of the RF unit 50 when set to the time information acquisition mode or the positioning information acquisition mode.

In addition, when set to the time information acquisition mode or the positioning information acquisition mode, the baseband unit 60 generates a local code of the same pattern as each C/A code in the satellite search step described below, and executes a process that correlates the local codes to the C/A code contained in the baseband signal. The baseband unit 60 adjusts the timing when the local code is generated so that the correlation to each local code peaks, and when the correlation equals or exceeds a threshold value, determines that the local code synchronized with the GPS satellite 10 (that is, that a GPS satellite 10 was captured). Note that the GPS system uses a CDMA (code division multiple access) method whereby all GPS satellites 10 transmit satellite signals on the same frequency using different C/A codes. Therefore, by identifying the C/A code contained in the received satellite signal, GPS satellites 10 from which satellite signals can be captured can be found.

When in the time information acquisition mode or the positioning information acquisition mode, the baseband unit 60 also executes a process that mixes the baseband signal with the local code of the same pattern as the C/A code of the GPS satellite 10 in order to acquire the satellite information for the synchronized GPS satellite 10. The navigation message containing the satellite information from the captured GPS satellite 10 is demodulated in the mixed signal. The baseband unit 60 then executes a process to detect the TLM word (preamble data) of each subframe in the navigation message, and acquire (such as store in SRAM 63) satellite information such as the orbit information and GPS time information contained in each subframe. The GPS time information as used here is the week number (WN) and Z count, but acquiring only the Z count data is possible if the week number was previously acquired.

The baseband unit 60 then generates the time adjustment information required to correct the internal time information based on the satellite information.

In the time information acquisition mode, the baseband unit 60 more specifically calculates the time based on the GPS time information, and outputs time adjustment information. The time adjustment information in the time information acquisition mode could be, for example, the GPS time information itself, or information about the time difference between the GPS time information and the internal time information.

However, in the positioning information acquisition mode, the baseband unit 60 more specifically calculates the position based on the GPS time information and orbit information, and acquires position information (more specifically the latitude and longitude of the location of the electronic timepiece 100 when the signals were received). The baseband unit 60 also references the time difference information stored in flash memory 66, and acquires time difference data related to the coordinates (such as the latitude and longitude) of the electronic timepiece 100 identified by the position information. The baseband unit 60 thus generates satellite time data (GPS time) and time difference data as the time adjustment information. The time adjustment information in the positioning information acquisition mode may be the GPS time and time difference data as described above, but the time difference between GPS time and the internal time may alternatively be used instead of using GPS time.

Note that the baseband unit 60 may generate the time adjustment information based on satellite information from one GPS satellite 10, but could generate the time adjustment information based on satellite information from plural GPS satellites 10.

Operation of the baseband unit 60 is synchronized to the reference clock signal output by the TCXO 65. The RTC 64 generates timing signals for processing the satellite signals. This RTC 64 counts up at the reference clock signal output from the TCXO 65.

The control display unit 36 includes a control circuit 70, drive circuit 74, and crystal oscillator 73.

The control circuit 70 has a storage unit 71 and RTC (real-time clock) 72, and controls various operations. The control circuit 70 can be rendered by a CPU, for example.

The control circuit 70 sends control signals to the GPS reception circuit 28, and controls the reception operation of the GPS reception circuit 28. Based on output from the voltage detection circuit 37, the control circuit 70 also controls operation of regulator 34 and regulator 35. The control circuit 70 also controls driving all hands through the drive circuit 74.

Internal time information is stored in the storage unit 71. The internal time information is information about the time kept internally by the electronic timepiece 100, and is updated at a reference clock signal generated by the crystal oscillator 73 and RTC 72. Updating the internal time information and moving the hands can therefore continue even when power supply to the GPS reception circuit 28 stops.

When the time information acquisition mode is set, the control circuit 70 controls operation of the GPS reception circuit 28, and corrects and stores the internal time information in the storage unit 71 based on the GPS time information. More specifically, the internal time information is adjusted to UTC (Coordinated Universal Time), which is obtained by subtracting the UTC offset from the acquired GPS time. When set to the positioning information acquisition mode, the control circuit 70 controls operation of the GPS reception circuit 28, and based on the satellite time information (GPS time) and time difference data, adjusts and stores the internal time information in the storage unit 71.

Navigation Message

A navigation message, which is a satellite signal transmitted from the GPS satellites 10, is described next. The navigation message is transmitted at a bit rate of 50 bps modulated by the carrier frequency of the GPS satellite 10. FIG. 4 shows the content of a navigation message.

Figure 4A:
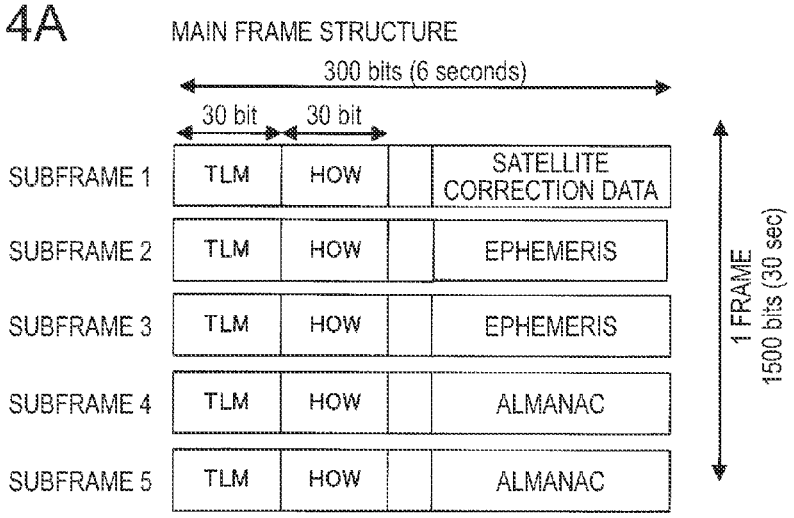
FIG. 4 shows the format of a navigation message received by the electronic timepiece 100, (A) showing the format of the main frame, (B) showing the format of a TLM word, (C) showing the format of a HOW word, and (D) showing the format of subframe 1 in detail.

As shown in FIG. 4A, a navigation message is composed of 1500 bits in one frame. One frame is divided into five subframes. Each subframe contains 300 bits of data. Because the bit rate is 50 bps, it takes 6 seconds to transmit one subframe, and 30 seconds to transmit one frame.

Subframe 1 contains satellite correction data such as the week number. Subframes 2 and 3 contain ephemeris data (precise orbit information for each GPS satellite 10). Subframes 4 and 5 contain almanac data (general orbit information for all GPS satellites 10 in the constellation).

Each of subframes 1 to 5 starts with a 30-bit telemetry (TLM) word followed by a 30-bit HOW word (handover word).

Therefore, while the TLM and HOW words are transmitted at 6-second intervals from the GPS satellites 10, the week number data and other satellite correction data, ephemeris, and almanac data are transmitted at 30-second intervals.

Figure 4B:
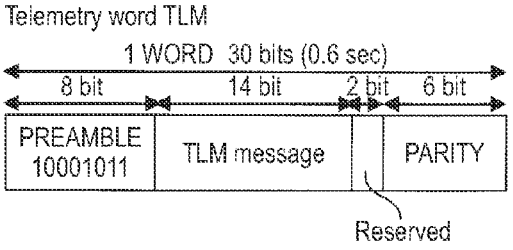

As shown in FIG. 4B, the TLM word contains a preamble (8 bits), a TLM message and reserved bits (16 bits), and parity (6 bits).

Figure 4C:
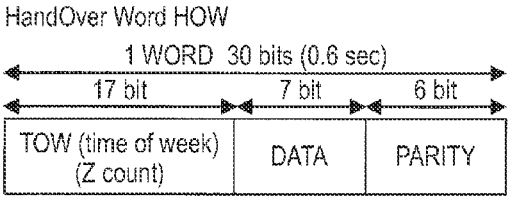

As shown in FIG. 4C, the HOW word contains GPS time information called the TOW or Time of Week (also called the Z count). The Z count denotes in seconds the time passed since 00:00 of Sunday each week, and is reset to 0 at 00:00 Sunday the next week. More specifically, the Z count denotes the time passed from the beginning of each week in seconds. The Z count denotes the GPS time at which the first bit of the next subframe data is transmitted.

For example, the Z count transmitted in subframe 1 denotes the GPS time that the first bit in subframe 2 is transmitted.

The HOW word also contains 3 bits of data denoting the subframe ID (ID code). More specifically, the HOW words of subframes 1 to 5 shown in FIG. 4A contain the ID codes 001, 010, 011, 100, and 101, respectively.

Figure 4D:
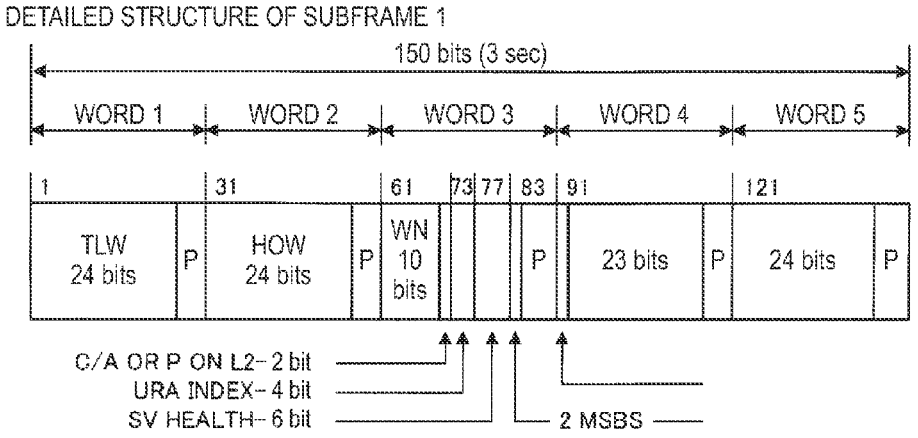

FIG. 4D shows the content of subframe 1 in detail. Satellite correction data such as the week number (WN) and satellite health information (SVhealth) is stored in word 3 of subframe 1. The week number identifies the week of the current GPS time information. More specifically, GPS time started at 00:00:00 on Jan. 6, 1980, and the week number of that week is week number 0. The receiver-side device can therefore get the GPS time by acquiring the week number and the elapsed time (seconds). The week number is updated every week.

The electronic timepiece 100 can get the GPS time by acquiring the week number contained in subframe 1 and the HOW words (Z count data) contained in subframes 1 to 5. However, if the electronic timepiece 100 has previously acquired the week number and internally counts the time passed from when the week number value was acquired, the current week number value of the GPS satellite 10 can be known without acquiring the week number from the satellite signal. The electronic timepiece 100 can therefore know the current time, except for the date, once the Z count is acquired. The electronic timepiece 100 therefore acquires only the Z count as the current time.

Note that the TLM word, HOW word (Z count), satellite correction data, ephemeris, and almanac parameters are examples of satellite signals in the invention.

Reception in the time mode in this embodiment of the invention means receiving the Z count, which is time information as described above. The Z count can be obtained from one GPS satellite 10. Because the Z count is carried in each subframe, it is transmitted every 6 seconds. As a result, reception in the time mode means a process in which at least one satellite is received, the reception time required to acquire one Z count is at most 6 seconds, the acquirable information is the Z count (time information), and the ephemeris and almanac parameters are not received. The required reception time enables receiving one Z count in 6 seconds, and reception can be completed in as short as 12 to 18 seconds even if two or three Z counts are received to verify the received data.

Reception in the positioning mode in this embodiment of the invention means receiving ephemeris data, which is precise orbit information for each GPS satellite 10, from at least three satellites. Ephemeris data must be received from at least three GPS satellites 10 for positioning purposes. Note that because the ephemeris are carried in subframes 2 and 3, the shortest time in which it can be received is 18 seconds (by receiving subframes 1 to 3). Therefore, when plural GPS satellites 10 are tracked and signals are received at the same time, approximately 30 seconds to 1 minute is required from a cold start in which no almanac data is locally stored in order to receive ephemeris data, calculate the position, and get positioning data.

Reception in the time mode in this electronic timepiece 100 is, in principle, an automatic process that automatically receives satellite signals at a specific time, and reception in the positioning mode is a manual process that runs when triggered by the user. Because the GPS week number is contained in subframe 1, both time and date information can be received in the shortest required time in the time mode if the start-reception time is set so that the automatic reception process can start at second 0 or second 3 of each minute when subframe 1 is transmitted if date information is also desired.

In addition to the automatic reception process that runs at a specific time, the time mode could also have a process that receives automatically when a specific condition is satisfied. For example, movement to an outdoor location where the time information can be easily received could be set as a specific condition for receiving automatically in the time mode. Moving outside could be detected when solar cell 22 output exceeds a specific threshold, for example. Note that because reception in the time mode is normally sufficient once a day, the automatic reception process is preferably configured to be triggered by the specific condition once a day only if the automatic reception process failed at the specified time.

Because signals from GPS satellites 10 are transmitted as described above, GPS reception in this embodiment of the invention means phase synchronizing with the C/A code from a particular GPS satellite 10. More specifically, the electronic timepiece 100 on the receiving side must synchronize with a GPS satellite signal in order to acquire GPS satellite 10 frame data. A C/A code (1023 chip (1 ms)) is used for synchronizing at the 1 ms level. This C/A code (1023 chip (1 ms)) is different for and unique to each of the plural GPS satellites 10 in orbit. The electronic timepiece 100, which is the receiver, can therefore receive satellite signals from a particular GPS satellite 10 by generating the C/A code specific to a particular GPS satellite 10 and phase synchronizing the locally generated C/A code with the received C/A code.

Once the receiver synchronizes with the C/A code (1023 chip (1 ms)), the preamble of the TLM word and the HOW word can be received from the subframe data, and the Z count can be acquired from the HOW word. After acquiring the TLM word and the Z count of the HOW word, the electronic timepiece 100 could continue to acquire the week number (WN) and satellite health (SVhealth) data.

A parity check can be used to determine the reliability of the acquired Z count. More specifically, the parity data following the TOW data in the HOW word can be used to check for errors. If the parity check detects an error, there is a problem with that Z count and the Z count is not used to adjust the time.

Leap Second Information

Figure 5:
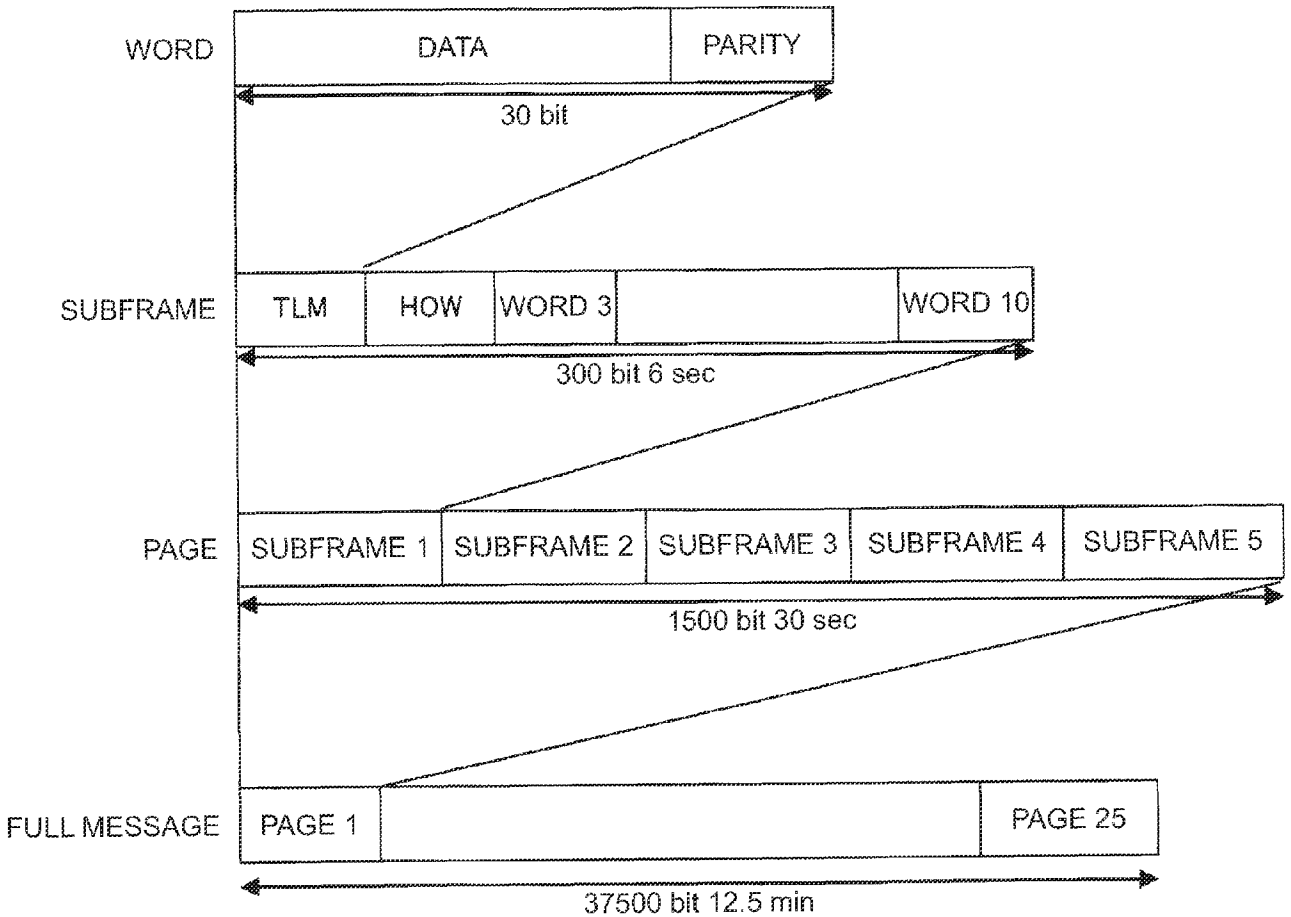
FIG. 5 shows the relationship between a subframe and a page of a navigation message received by the electronic timepiece 100.

As shown in FIG. 5, the complete navigation message described above consists of 25 pages from page 1 to page 25. Each GPS satellite 10 repeatedly transmits navigation messages consisting of these 25 pages (complete navigation message). Each page is also called a frame and is 1500 bits long. Because the navigation message is transmitted at 50 bps, transmitting one page (frame) takes 30 seconds, and transmitting 25 pages (the complete navigation message) takes 30 s×25=750 s=12.5 min.

Subframes 1 to 3 carry the same data on each page. However, subframes 4 and 5 store information related to all satellites in the constellation, such as the almanac (orbit information for all GPS satellites 10). Because of the large amount of data, subframes 4 and 5 carry different data on each page.

The leap second information is contained in subframe 4 of page 18. In addition to the TLM word and HOW word, subframe 4 of page 18 stores the ionospheric correction factors (ICF) $\alpha_0$ to $\alpha_3$ and $\beta_0$ to $\beta_3$ in words 3 to 5, and stores UTC parameters $A_1$ and $A_0$ in words 6, 7, 8 as shown in FIG. 6. The leap second information is stored in words 8 to 10. More specifically, epoch time information is stored in $t_{0t}$ and $WN_t$ in word 8; the current leap second is stored in $\Delta t_{LS}$, the leap second update week is stored in $WN_{LSF}$, and the leap second update day is stored in DN in word 9; and the leap second after updating is stored in $\Delta t_{LSF}$ in word 10.

The GPS navigation message is transmitted in week units, and transmission therefore restarts from page 1 at 00:00:00 Sunday every week. Counted from 00:00:00 Sunday every week, subframe 4 of page 18 is therefore transmitted at 00:08:48 of GPS time. More specifically, because 30 seconds is required to transmit one page of the navigation message from subframe 1 to subframe 5 as shown in FIG. 5, 30 s×17=510 s is required to finish transmitting page 17. In addition, 6 s×3=18 s is required to finish transmitting subframe 1 to subframe 3. As a result, 510 s+18 s=528 s=8 minutes 48 seconds are required before subframe 4 of page 18 can be received. Starting from 00:00:00 Sunday, this means that receiving subframe 4 of page 18 is possible starting from 00:08:48 Sunday.

Because transmitting the full navigation message takes 12.5 minutes as shown in FIG. 5, subframe 4 of page 18 can also be received at 00:21:18, 00:33:48 and so forth. FIG. 7 shows the GPS times at which subframe 4 of page 18 can be received through 23:51:18 Saturday.

To enable acquiring the time when subframe 4 of page 18 can be received without computing an equation, a table of hour, minute, second, and weekday data as shown in FIG. 7 could be stored in ROM, and the time matching the internal time kept by the electronic timepiece 100 could be looked up from the table. However, if one byte is used to store each of the hour, minute, second, and weekday values, 806×4=3223 bytes of storage capacity is required to store all of the data in the table. Searching such a table is time-consuming for a low-power processor, and power consumption will increase as the reception time increases.

Leap Second Information Reception Time Table

The invention reduces the required data storage capacity and simplifies searching by storing the leap second reception time information in tables grouped by hour and by minute and second as shown in FIG. 8A and FIG. 8B.

More specifically, there are five patterns 0 to 4 of minute and second values at which the leap second information can be received in any one-hour period. A table relating these five patterns to the hour from 0 to 23 and the weekday from Sunday to Saturday was therefore compiled as shown in FIG. 8A. If one byte is required to store one combination, 5×5=25 bytes is sufficient to store the table shown in FIG. 8A.

Using the number of each pattern as the table number, a table relating the combinations of minute and second values of the leap second reception times to each table number was compiled as shown in FIG. 8B. If one byte is required to store each minute and second value, 10 bytes are required for the minute and second values in table 0; 8 bytes are required for table 1; 10 bytes for table 2; 10 bytes for table 3; and 10 bytes for table 4. A total 48 bytes is therefore sufficient to store the table shown in FIG. 8B.

Because 25 bytes of capacity are needed to store the table in FIG. 8A and 48 bytes are needed for the table in FIG. 8B, the leap second reception time can be found using a table of a total 73 bytes. This table can be stored in significantly less space than is required for the 3224 bytes in the table shown in FIG. 7, the time required for searching can be reduced, and power consumption can be reduced by reducing the reception time.

Reception Control Process

The reception control process of an electronic timepiece 100 using the tables shown above is described next. Note that the leap second reception time tables shown in FIG. 8A and FIG. 8B denote the time at which leap second transmission from the GPS satellites 10 starts in GPS time.

Figure 9:
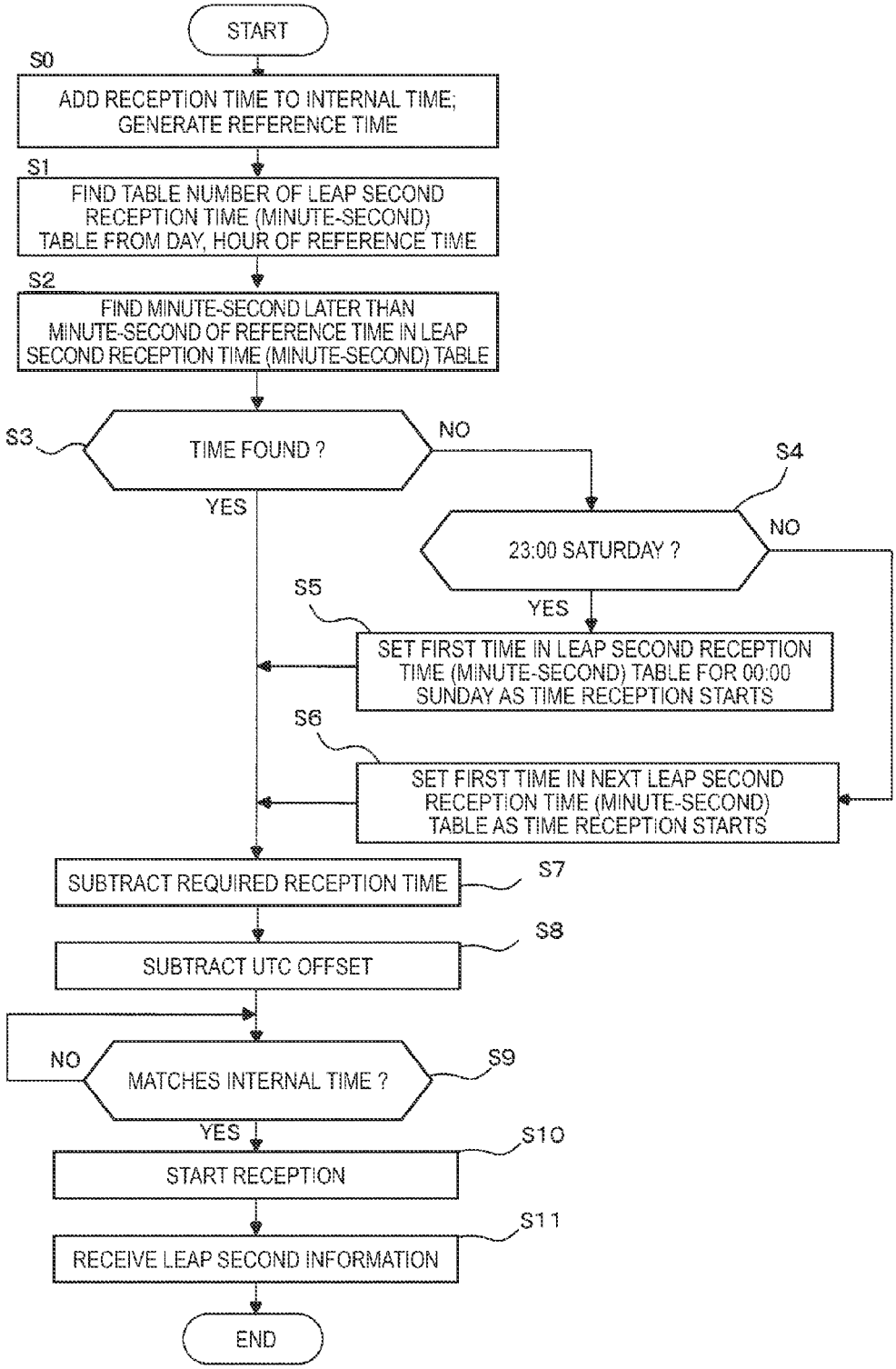
FIG. 9 is a flow chart of the reception control process in a first embodiment of the invention.

FIG. 9 shows the content of the reception control process. The control circuit 70 first adds the reception time (such as 30 s) to the internal time to get a reference time (S0). The control circuit 70 then searches the leap second reception time (hour) table in FIG. 8A to get the table number corresponding to the reference time and weekday (S1). Next, the control circuit 70 searches the leap second reception time (minute-second) table in FIG. 8B to find the minute and second combination following the minute and second of the reference time (S2).

The control circuit 70 knows from the result of this search if there is a time with minute and second values later than the minute and second values of the reference time in the leap second reception time (minute-second) table (S3). If such a time is found, the control circuit 70 saves it in memory.

If such a time is not found, whether the reference time is in the 23:00 hour of Saturday (S4). This is because the GPS navigation message is transmitted in week units and transmission restarts from page 1 at 00:00:00 Sunday every week, and even if the current page is before subframe 4 of page 18, the leap second reception time after returning to page 1 must be acquired. Therefore, if the current time is 23:00 Saturday, the first time in the minute-second reception time table for 00:00 Sunday is set as the start-reception time (S5). More specifically, the control circuit 70 saves 00:08:48 as the reception time.

If such a time is not found and the current time is not 23:00 Saturday, the first time in the next leap second reception time (minute-second) table is saved as the start-reception time.

In this embodiment of the invention the leap second reception time tables shown in FIG. 8A and FIG. 8B contain the time leap second transmission starts from the GPS satellite 10, and does not consider the UTC offset. The reception time adjustment process and UTC offset subtraction process described below are therefore executed.

The required reception time will vary according to the processing capacity of the receiver, and reception requires 30 seconds with the GPS reception circuit 28 in this embodiment of the invention, for example. Because the leap second reception time acquired from the leap second reception time table is the time transmission of the leap second information starts, a reception time of 30 seconds is subtracted from this transmission start time (S7).

Because the leap second reception time acquired from the leap second reception time tables is the time when leap second information transmission starts and is not adjusted for the UTC offset, the UTC offset is subtracted from the difference obtained by subtracting the reception time (S8).

UTC is adjusted for leap seconds on the last day of December or June, or the last day of March and September, for example. However, because GPS time does not have leap seconds, the difference between GPS time and UTC (the UTC offset) increases every time UTC is adjusted for leap seconds. This embodiment of the invention subtracts a UTC offset of 15 seconds from the value retrieved from the leap second reception time (minute-second) table in FIG. 8B (S8).

After acquiring the leap second reception time, whether the internal time matches the leap second reception time is determined, and operation waits until the times match (S9). Receiving subframe 4 of page 18 then starts when the internal time matches the leap second reception time (S10). The leap second information is then received from subframe 4 of page 18 (S11).

This is described more specifically below. In this example the internal time is 00:00:00 on Friday, Dec. 10, 2011. As a result, table number 0 is retrieved from the table in FIG. 8A. The minute-second combinations for table 0 in FIG. 8B are then searched for a minute and second combination that is later than 00 m 00 s. A time of 8 m 48 s is found in the minute-second values for table 0. The leap second reception time is therefore set to 00:08:48 on Friday, Dec. 10, 2011.

In another example the internal time is 00:59:00 on Friday, Dec. 10, 2011. As a result, table number 0 is retrieved from the table in FIG. 8A. The minute-second combinations for table 0 in FIG. 8B are then searched for a minute and second combination that is later than 59 m 00 s. However, because the minute-second combinations for table 0 do not include a time later than 59 m 00 s, the first time in the next table 1, that is, 11 m 18 s, is used as the leap second reception time. The leap second reception time is therefore set to 01:11:18 on Friday, Dec. 10, 2011.

In another example the internal time is 23:52:00 on Saturday, Dec. 11, 2011. In this case, table number 2 is retrieved from the table in FIG. 8A. The minute-second combinations for table 2 in FIG. 8B are then searched for a minute and second combination that is later than 52 m 00 s. However, because the minute-second combinations for table 2 do not include a time later than 52 m 00 s, and the hour is 23:00 on Saturday, the first time in the leap second reception time table for 00:00 Sunday, that is, 8 m 48 s, is used as the leap second reception time instead of searching the next table number for minute-second values. The leap second reception time is therefore set to 00:08:48 on Sunday, Dec. 12, 2011.

As described above, this embodiment of the invention can quickly and easily find the leap second reception time even when using a low-power processor because the leap second reception times can be stored in tables containing little data. As a result, power consumption can be reduced by shortening the reception time.

Furthermore, because the reception time, which can vary according to the processing capacity of the receiver, and the UTC offset do not need consideration when compiling the leap second reception time tables shown in FIG. 8A and FIG. 8B, precompiled leap second reception time tables can be used effectively.

Embodiment 2

Figure 10:
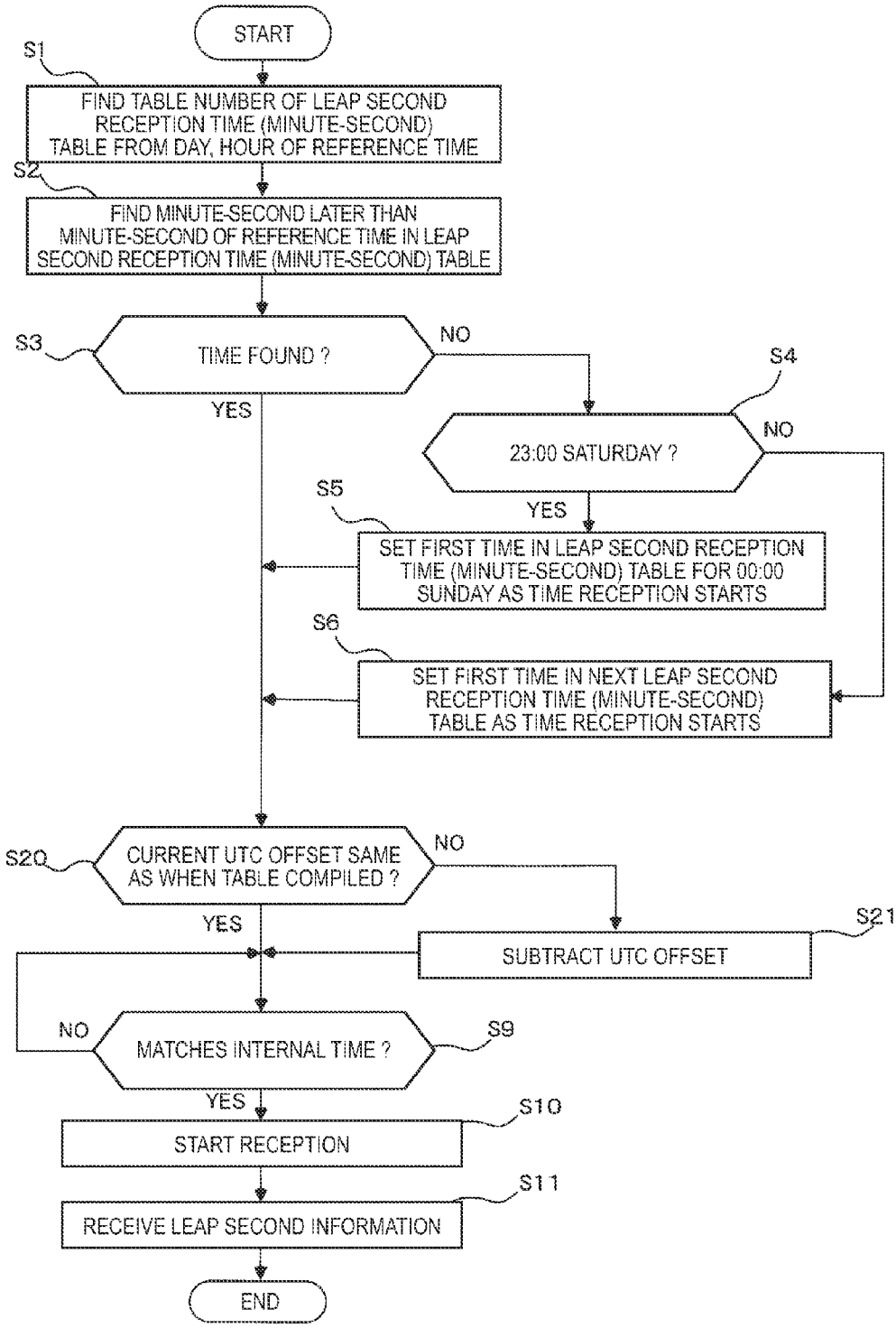
FIG. 10 is a flow chart of the reception control process in a second embodiment of the invention.

FIG. 10 is a flow chart of the reception control process according to a second embodiment of the invention. Steps that are the same as in the process used in the first embodiment shown in FIG. 9 are identified by like reference numerals and further description thereof is omitted.

The leap second reception time tables in this embodiment of the invention express the start-reception time in terms of UTC by using a UTC offset of 15 seconds and subtracting the UTC offset from GPS time. The operation of step S0 in FIG. 9 is not performed in this second embodiment, and a reference time is therefore not generated. As a result, the internal time is used for comparison in S1 and S2. The table correlating the five minute-second combinations of the leap second reception time shown in FIG. 8A to the hours from 0 to 23, and the weekdays from Sunday to Saturday, also does not change in this embodiment.

However, the table correlating the table number to the minute-second combinations of the leap second reception time, where the table number is the number of a particular pattern, changes to the difference of the minute-second values shown in FIG. 8B minus the UTC offset of 15 seconds. For example, the first minute-second combination for table 0 becomes 08 m 33 s.

In the reception control process shown in FIG. 10, the leap second reception time acquisition steps (S1 to S6) and the leap second information reception process (S9 to S11) are the same as in the first embodiment shown in FIG. 9. In this embodiment of the invention the leap second reception time table stores the leap second reception times as the start-reception time expressed in UTC using a UTC offset of 15 seconds. As described above, however, the UTC offset increases each time the leap second is adjusted. Therefore, if the leap second is adjusted after the table is compiled, the time acquired from the table will differ from the actual UTC.

This embodiment of the invention therefore determines if the current UTC offset is the same as the UTC offset that was used to compile the table (S20). If they are not the same, the difference of the UTC offsets is subtracted from the leap second reception time that was stored as described above (S21). For example, the tables in this embodiment of the invention are compiled using a 15-second UTC offset, but if the current UTC offset goes to 17 seconds, the difference of 2 is subtracted from the leap second reception time. The leap second information reception process is then executed as described in the first embodiment above (S9 to S11) using this resulting leap second reception time.

Because the UTC offset is reflected in the minute-second data when compiling the leap second reception time table in this embodiment of the invention, the leap second reception time acquired from the table can be used directly if the UTC offset used to compile the lookup table is the same as the current UTC offset.

In addition, even if the UTC offset differs from the current offset, the leap second reception time is adjusted to reflect the UTC offset difference, and the leap second information can be correctly received.

The capacity of the storage area of the hour, minute, second, and weekday values in the leap second reception time tables is based on 1 byte each in the embodiments described above, but the invention is not so limited and a different value can be used as desired.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. An electronic timepiece comprising:

a reception unit that receives a satellite signal from a satellite that transmits a satellite signal containing time information and leap second information;

a control unit that controls the reception unit to receive the time information and the leap second information from the satellite signal, and adjusts an internal time based on the time information and leap second information;

a first table that groups combinations of reception-minute and reception-second values common to plural reception-hours into a plurality of minute-second patterns based on leap second reception time data expressing leap second information reception times by means of reception-hour, reception-minute, reception-second, and reception-day values, and relates an identification value for the plural minute-second patterns to the reception-day and reception-hour values; and a second table that stores reception-minute and reception-second combinations for each identification value;

wherein the control unit acquires a leap second reception time that is later than the internal time from the first table and the second table, and controls the reception unit to receive the leap second information based on the acquired leap second reception time.

2. The electronic timepiece described in claim 1, wherein:

the leap second reception time denotes a start-reception time for leap second information as the difference of the time leap second information transmission starts minus the difference between the time information and Universal Coordinated Time (UTC); and if the difference between the time information and UTC changes from when the first table and the second table were compiled, the control unit controls the reception unit to receive the leap second information when the internal time matches the time difference of the minute-second combination corresponding to the acquired identification value minus the change.

3. The electronic timepiece described in claim 2, wherein:

the leap second reception time expresses the time to start receiving leap second information in terms of UTC.

4. The electronic timepiece described in claim 1, wherein:

the leap second reception time is the time leap second information transmission starts; and the control unit subtracts the time required for reception from the leap second reception time, and when this difference minus the difference between the time information and UTC matches the internal time, controls the reception unit to receive the leap second information.

5. The electronic timepiece described in claim 4, wherein:

the leap second reception time is the time leap second information transmission starts as expressed by the time information in the satellite signal.

6. A reception control method for an electronic timepiece that has a reception unit that receives a satellite signal from a satellite that transmits a satellite signal containing time information and leap second information, a control unit that controls the reception unit to receive the time information and the leap second information from the satellite signal, and adjusts an internal time based on the time information and leap second information, a first table that groups combinations of reception-minute and reception-second values common to plural reception-hours into a plurality of minute-second patterns based on leap second reception time data expressing leap second information reception times by means of reception-hour, reception-minute, reception-second, and reception-day values, and relates an identification value for the plural minute-second patterns to the reception-day and reception-hour values, and a second table that stores reception-minute and reception-second combinations for each identification value, the reception control method including steps of:

acquiring the minute-second pattern identification value from the first table based on the day and hour of the internal time;

acquiring a reception-minute and reception-second combination that is later than the internal time from the minute-second combinations corresponding to the acquired identification value;

determining if the internal time matches the reception-day and reception-hour corresponding to the acquired identification value and the acquired reception-minute and reception-second combination; and starting receiving the leap second information if the internal time matches.

7. The reception control method for an electronic timepiece described in claim 6, wherein:

the leap second reception time denotes a start-reception time for leap second information as the difference of the time leap second information transmission starts minus the difference between the time information and Universal Coordinated Time (UTC), the control method also including steps of determining if the difference between the time information and UTC changed from when the first table and the second table were compiled; and if the difference changed, subtracting the change from the minute-second combination corresponding to the acquired identification value.

8. The reception control method for an electronic timepiece described in claim 6, wherein:

the leap second reception time data denotes the time transmitting the leap second information starts;

the reception control method also including steps of:

subtracting time required for reception from the acquired reception-day and reception-hour corresponding to the acquired identification value and the acquired reception-minute and reception-second combination; and subtracting from this difference the difference between the time information and UTC.

* * * * *